US005662483A

United States Patent [19]

Park et al.

[11] Patent Number: 5,662,483

[45] Date of Patent: Sep. 2, 1997

[54] SURGE VOLTAGE PREVENTING D-SUB CONNECTOR

[75] Inventors: Sung-un Park, Kyonggi-do; Noh-byung Park, Seoul; Ju-seo Park, Kyonggi-do, all of Rep. of Korea

[73] Assignee: SamSung Electronics Co., Ltd., Suwon, Rep. of Korea

[21] Appl. No.: 572,723

[22] Filed: Dec. 14, 1995

[30] Foreign Application Priority Data

Dec. 15, 1994 [KR] Rep. of Korea ..... 94-34408
Jan. 20, 1995 [KR] Rep. of Korea ..... 95-987

[51] Int. Cl.[6] ..... H01R 4/66

[52] U.S. Cl. ..... 439/101; 439/924.1

[58] Field of Search ..... 439/101, 108, 439/188, 924.1, 733.1

[56] References Cited

U.S. PATENT DOCUMENTS

| | | | |
|---|---|---|---|
| 2,911,609 | 11/1959 | Burtt et al. | 439/733.1 |
| 4,084,875 | 4/1978 | Yamamoto . | |
| 4,217,024 | 8/1980 | Aldridge et al. | 439/733.1 |
| 4,439,001 | 3/1984 | Curley et al. | 439/733.1 |
| 4,568,133 | 2/1986 | Amano et al. | 439/108 |
| 4,849,944 | 7/1989 | Matsushita . | |
| 4,867,690 | 9/1989 | Thumma | 439/924.1 |
| 5,088,931 | 2/1992 | Niciolo et al. | 439/188 |
| 5,092,799 | 3/1992 | Kimura | 439/924.1 |
| 5,176,528 | 1/1993 | Fry et al. | 439/181 |
| 5,268,592 | 12/1993 | Bellamy et al. . | |
| 5,295,856 | 3/1994 | Endo et al. | 439/364 |
| 5,403,196 | 4/1995 | Northey et al. | 439/108 |

FOREIGN PATENT DOCUMENTS

| | | | |
|---|---|---|---|
| 4-133280 | 5/1992 | Japan | 439/924.1 |

*Primary Examiner*—Neil Abrams
*Assistant Examiner*—Tho D. Ta
*Attorney, Agent, or Firm*—Robert E. Bushnell, Esq.

[57] ABSTRACT

An electrical coupling configured to prevent voltage surges during coupling and uncoupling. A plurality of ground terminals and a plurality of signal terminals are arrayed to open onto an exterior mating surface of an electrical coupling such as a D-sub type electrical connector, with the distal ends of the ground terminals protruding outwardly farther from their corresponding pinholes towards the exterior mating surface than the distal ends of the signal terminals. These configurations prevent the input and output controlling circuit stages from being disabled by the occurrence of noise superimposed upon the power lines or momentary surges of voltage generated while the system is temporarily ungrounded during coupling, with an assurance that during coupling, the ground terminals establish electrically conducting paths before the signal terminals. These configurations are suitable for printer cables, repeater cables and connector cables of other devices.

13 Claims, 3 Drawing Sheets

SURGE VOLTAGE PREVENTING D-SUB CONNECTOR

CROSS REFERENCE TO RELATED APPLICATIONS

This application makes reference to, incorporates the same herein, and claims all benefits accruing under 35 U.S.C.§119 from an application for SURGE VOLTAGE PREVENTING D-SUB CONNECTOR earlier filed in the Korean Industrial Property Office on 15 Dec. 1994 and there assigned Serial No. 34408/1994 and filed on 20 Jan. 1995 and there assigned Serial No. 987/1995.

BACKGROUND OF THE INVENTION

1. Field of the Invention

The present invention relates to a surge voltage preventing D-sub connector, and more particularly, to printers, repeaters, or other device that uses a connector cable that is coupled to a surge voltage preventing female-type D-sub connector usable in a computer, constructed so that the ground terminal is grounded before the signal terminal.

2. Description of the Background Art

In general, a D-sub connector is a computer connector, to which a connector cable of a printer, a repeater or another device may be coupled. A female-type connector and a male-type connector are intended to be coupled with each other. A female-type D-sub connector may have an array of twenty-five pinholes with the signal pinholes conventionally numbered one through seventeen, and the grounding pinholes conventionally numbered eighteen through twenty-five. An internal construction of the conventional D-Sub connector, as it now exists, includes a female-type connect pin located in each pin hole, to which a pin of a male-type connector will be coupled. The corresponding pins coincide with each other and electronic signal lines are coupled when a printer or other connector cable is inserted into the female D-sub connector.

In a conventional D-sub connector however, the length of the pins of the ground terminal and a signal terminal are the same. We have observed that if a user inserts a printer cable or a repeater cable obliquely into a connector, an electrical connection may be established via a signal line earlier than the electrical coupling between the ground pins of the cable and the ground terminal of the connector. Consequently, undesired noise superimposed upon the power conductors or a momentary voltage surge to the system may be generated by the ground signals occurring when the ground pins of the cable are subsequently coupled with the ground terminal, resulting in consequential damage to the input-output controlling chips.

One recent effort to implement the concept of sequential mating to protect the electronic components in a circuit may be noted in U.S. Pat. No. 5,268,592 to Bellamy. Bellamy however, is suitable principally for circuit cards in electronic circuit boards, and not for D-sub connectors, and Bellamy achieves sequential mating by having the male ground pins protrude farther out from a connector than the signal male pins. We have found that this makes the male ground pins more susceptible to bending or other damage, often resulting in damage that necessitates replacement of the entire cable.

SUMMARY OF THE INVENTION

It is therefore, an object of the present invention to provide an improved surge voltage preventing electrical connector.

It is another object to provide a surge voltage preventing type D-sub connector.

It is still another object to provide a female-type D-sub connector for a printer connector cable or a repeater connector cable, to prevent damage to the input-output controlling functions due generation of a surge voltage generated.

It is yet another object to provide a connector able to establish paths of electrical conduction via an array of ground pins earlier than establishing paths of electrical conduction via other pins when the connector cable is coupled to a D-sub type connector.

These and other objects may be achieved with a D-sub connector constructed according to the principles of the present invention having a plurality of ground pinholes and signal pinholes perforating the connector and opening onto a single, continuous mating surface. The electrically conducting fingers installed in a plurality of the ground pinholes are, in different configurations, positioned nearer to the mating surface of the connector than are electrically conducting fingers installed in the plurality of signal pinholes opening to the same mating surface. In alternative embodiments these configuration achieve sequential mating of ground leads and data signal leads by varying the depth that the electrically conducting fingers that are positioned in the female pin holes.

DETAILED DESCRIPTION OF THE INVENTION

Figure 1:
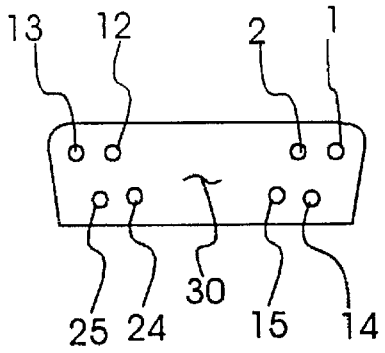
FIG. 1 is a schematic view showing a pin-arrangement of a typical conventional female D-sub connector.
Figure 2:
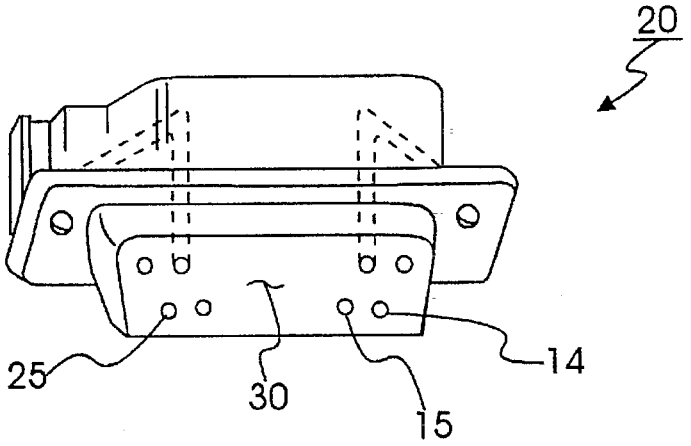
FIG. 2 is a perspective construction view of a typical conventional female D-sub connector.

Turning now to the drawings, FIG. 1 is a bottom planar view showing the pinhole arrangement for a representation of a commercially available female D-sub connector. An exterior continuous, flat mating surface 30 is perforated by twenty-five pinholes arrayed in two linear arrays. The pinholes numbered as 1 through 17 are the signal conductors, while the pinholes numbered as 18 through 25 are grounded conductors, that is, electrical conductors coupled to a reference potential such as a local, or system, ground potential. FIG. 2 shows in perspective, a construction view of the salient features of a typical commercially available female D-sub connector 20, with the flat exterior mating surface 30 performated by the two linear arrays of pinholes shown in FIG. 1. For this reason, the external views of FIGS. 1 and 2 are similar, in some particulars, for both conventional D-sub connectors and for D-sub connectors constructed according to the principles of the present invention.

Figure 3:
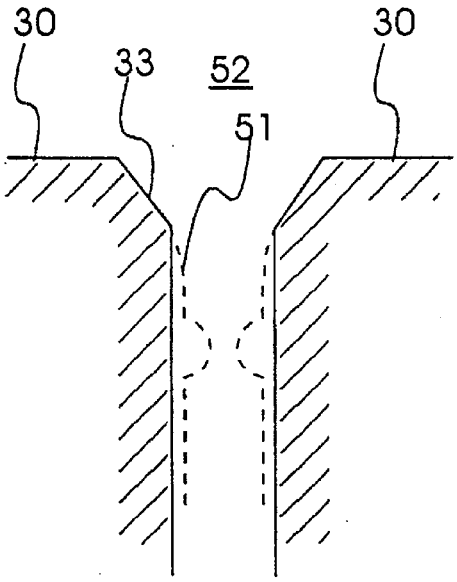
FIG. 3 is a cross-sectional view of a conventional pinhole containing an electrically conducting finger.

FIG. 3 shows in cross-section, the details of the construction of a conventional pinhole 52 for a D-sub connector of the type represented in FIGS. 1 and 2. The distance between the pair of electrically conducting fingers 51 positioned along opposite interior cylindrical sidewalls of pinhole 52 and the external mating surface 30 of the connector is typically, by convention, about 1.1 mm. Consequently, the distal ends of fingers 51 terminate slightly below the junction formed between the bevelled portion 33 and the parallel vertical interior sidewalls of cylindrical pinhole 52. This construction is common to both those pinholes dedicated to transmission of data signals and to those pinholes dedicated to providing a continuity of electrical ground between the connector and a cable (not shown) mated with the connector.

Figure 4:
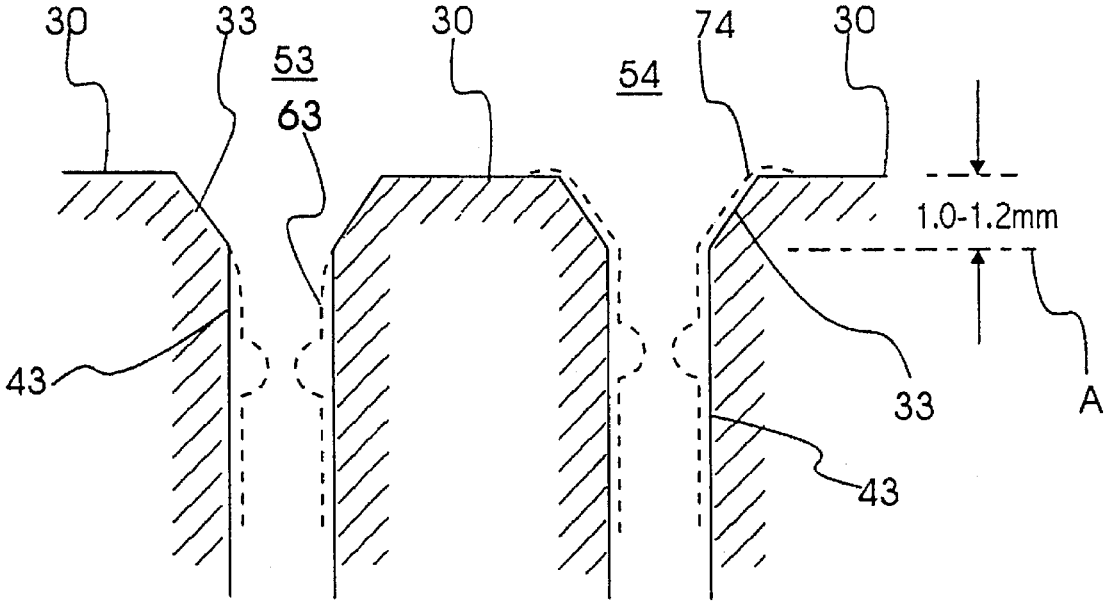
FIG. 4 is a detailed cross-sectional view showing data signal pinholes and ground potential pinholes formed within a connected constructed as a first embodiment of the present invention.

Turning now to FIG. 4, the cross-section of the pinholes of a connector constructed as a first embodiment in accordance with the principles of the present invention contemplates that there are two types of pinholes. In the embodiment shown in FIG. 4, differences exist principally between the fingers serving as electrically conducting terminals 63 positioned with pinholes dedicated to transmission of data signals and to the fingers serving as electrically conducting terminals 74 positioned within those pinholes dedicated to providing a continuity of electrical ground between the connector and a cable (not shown) mated with the connector. Pinholes 53, 54 are formed within a volume of material best characterized as an electrical insulator, when compared to the material of terminals 63, 74. The embodiment shown in FIG. 4 may be constructed with identical profiles of the internal sidewall for both the signal pinholes 53 and for the ground pinholes 54. Differences occur however, in the locations, lengths and relative dispositions of electrically conducting fingers 63, 74 extending within and along the cylindrical sidewalls of the pinholes, and need not occur in the shapes, cross-sectional dimensions or profiles of the Sidewalls forming pinholes 53, 54.

In the embodiment shown by the cross-sectional view of FIG. 4, signal and ground pinholes 53, 54 may be constructed to be identical to the cross-sectional view of a conventional pinhole as shown in FIG. 3. Data signal pinhole 53 has the same internal sidewall profile as ground pinhole 54. This internal wall profile can be described as having two portions. The first portion 33 is adjacent to the external mating surface 30 and is a bevelled circular entry portion, where the diameter is greatest at external mating surface 30. The second portion 43 is a cylindrical portion which is preferably coaxially concentric to the first bevelled portion. The diameter of cylindrical portion 43 is equivalent to the diameter of the first portion at its minimum. As a result, in neither data signal pinhole 53 nor in ground potential pinhole 54 is any lip or shoulder formed at the junction between first portion 33 and second portion 43.

One principal difference between the ground and the signal pinholes for the embodiment represented by FIG. 4 lies in the position and relative lengths of the electrically conducting fingers 63, 74 disposed respectively within pinholes 53, 54. Electrically conducting ground potential fingers 14 are located entirely within the cylindrical portion 43 of data signal pinhole 53, while electrically conducting ground potential fingers 74 extend along and over bevelled portion 33 of hole 54, with the distal ends terminating fingers 74 extending onto exterior mating surface 30.

Figure 5:
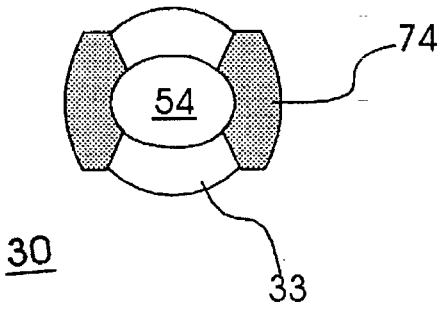
FIG. 5 is a top view illustrating the exterior appearance of one of the ground pinholes in the first embodiment shown in FIG. 4.

FIG. 5 is a top view of one of the ground pinholes 54 in a connector constructed according to the the principles illustrated by FIG. 4. Electrically conducting ground potential fingers 74 fold laterally over the bevelled portion 33 and the distal ends fingers 74 reach and extend partially coextensively with external mating surface 30. The distal ends of fingers 74 terminate on mating surface 30.

A reference basis 'A' is shown in FIG. 4 to illustrate a comparison between the termination of the distal ends of fingers 74 relative to the conventional ground potential pinholes 52 in FIG. 3. In the embodiment represented by FIG. 4, fingers 74 extend between 1.0 to 1.2 mm from the junction between sidewall 43 and bevelled portion 33, and onto exterior mating surface 30. In the first embodiment, electrically conducting finger 63 is positioned entirely within pinhole 53, and preferably entirely below reference basis A. Meanwhile, ground pinhole 54 shows the electrically conducting finger 74 crossing and extending outwardly from the reference basis A towards the external border 30. By drawing the reference basis A in FIG. 4, it can be observed that the electrically conducting fingers of the ground pins extend closer to mating surface 30 than in conventional connectors, while the electrically conducting fingers 63 in the signal pinholes extend only to somewhat below the junction between sidewall 43 and bevelled portion 33.

In the embodiment of FIG. 4, if a male pin D-sub connector (not shown), with all the pins protruding beyond a mating surface by an equal distance, was to be fastened to the female connector of the type illustrated by FIG. 4, the ground pins would make electrical contact with electrical fingers 74 in their corresponding ground pinholes 54 before the signal pins would make electrical contact with the electrically conducting fingers 63 in their corresponding signal pinholes 53. This is true even if the male and female connectors initially come in to contact with an oblique angle between their respective mating surfaces.

Figure 6:
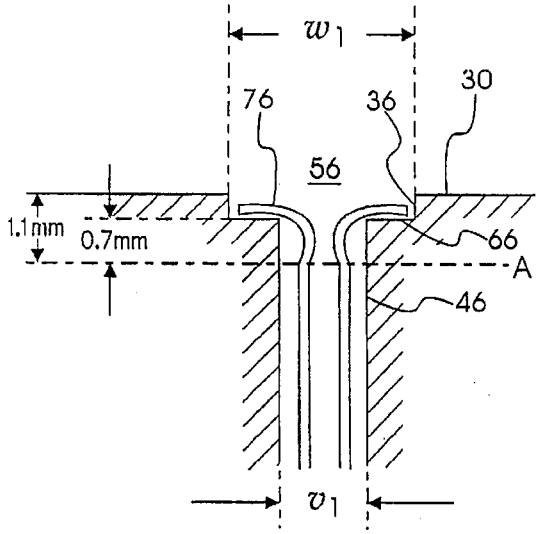
FIG. 6 is a cross-sectional view of a ground pinhole constructed as a second embodiment of the present invention.
Figure 7:
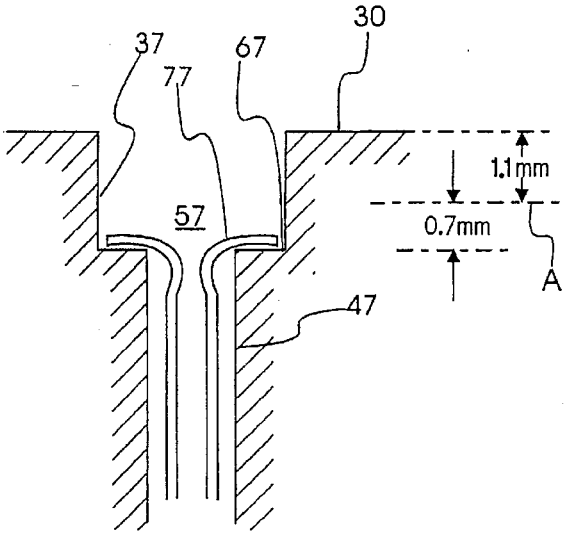
FIG. 7 is a cross-sectional view a signal pinhole constructed for the second embodiment of the present invention.

A second embodiment of the invention is illustrated by FIGS. 6 and 7. This second embodiment operates under a slightly different application of the principle of sequential mating, achieved by having the electrically conducting fingers 76 of the female ground pinholes 56 extend closer to the exterior mating surface 30 than the electrically conducting fingers 77 in the signal pinholes 57. As a result, a male D-sub connector with pins for transmission of data signals and a reference potential such as a local, or system ground potential, protruding by equal distances will sequentially mate with first the electrically conducting ground potential fingers 76 and then with the data signal fingers 77 in the female connector. In other words, the ground potential male pins will make electrical contact with the electrically conducting fingers 76 within the female ground pinholes 56 before the data signal conducting male pins make electrical contact with the electrically conducting fingers 77 within the signal female pinholes 57. Should there be any static charge built up in the circuit before mating, the charge would be carried by the ground pins to ground potential contact fingers 76 prior to the mating of the signal pins with the signal fingers 76, and therefore the static charge could not be deleteriously conducted via signal electrically conducting fingers 77 to the input and output circuit stages. Thus, electronic devices equipped with an electrical connector of the type shown in FIGS. 6 and 7 would be protected from harmful static discharge by varying the female pinholes, not the male pins.

This second embodiment is characterized by the unique internal sidewalls of the pinholes, and how the internal sidewall of the ground pinholes differ from the internal sidewall of the signal pinholes. Both ground pinholes 56 and signal pinholes 57 may be constructed with a first cylindrical portion, 36 for the ground pinholes, 37 for the signal pinholes, both situated adjacent to the exterior mating surface 30. These first cylindrical portions have a first diameter $w_1$. Both ground pinholes 56 and signal pinholes 57 also have a second cylindrical portion, 46 for the ground pinholes, 47 for the signal pinholes, that are both coaxially concentric to the first cylindrical portion and extend inwardly into the device away from the external border 30, starting at the first cylindrical portion. The second cylindrical portion has a second diameter $v_1$; because $v_1$ is less than $w_1$, a shoulder 66, 67 is formed respectively in the ground potential and signal pinholes. Shoulders 66, 67 occur where the second cylindrical portion joins the first cylindrical portion. In the second embodiment, the ground and signal pinholes differ in that the first cylindrical portion of the signal pinholes 37 extends substantially farther inwardly from mating surface 30 and into the device than the first cylindrical portion of the ground pinholes 36. From this, it follows that the shoulder 66 of the ground pinholes 56 is located closer to exterior mating surface 30 than shoulder 67 for signal pinholes 67. For both the ground and signal pinholes, electrically conductive fingers, 76 for the ground pinholes, 77 for the signal pinholes, extend throughout the second cylindrical portions reaching the shoulder at which point they are bent so that they at least partially cover part of and lie partially coextensively with the shoulder. As a result, the distance in a ground pinhole 56 between the exterior mating surface 30 and the electrically conducting fingers 76 is less than the distance in a signal pinhole 57 between the exterior mating surface 30 and the electrically conducting fingers 77.

In the second embodiment, as in the first embodiment, if a male connector (not shown) having male pins protruding from its mating surface by an equal distance is connected to a female D-sub connector, the ground terminals will establish electrical contact before the signal terminals. If there was any static electricity built up in the circuits, it would be discharged to ground, not to the electrical components. This embodiment protects the electronic circuits from harmful static electric discharge.

In FIGS. 6 and 7, reference basis A is illustrated to show where the electrically conducting fingers would extend relative to a conventional pinhole. FIGS. 6 and 7 show the second embodiment where the distance between the electrically conducting fingers and the exterior mating surface for the signal and ground pinholes respectively is the basis value plus or minus a constant value. In FIGS. 6 and 7, this constant value is approximately 0.7 mm. Thus, in the signal pinhole 57, the distance between the external border 30 and electrically conducting finger 77 is 1.1 mm+0.7 mm=1.8 mm. For the ground pinhole 56, 1.1 mm–0.7 mm=0.4 mm is the distance between the exterior mating surface 30 and the electrically conducting finger 76.

Figure 8:
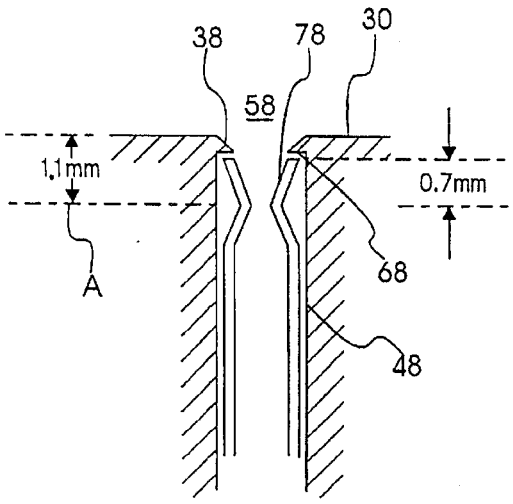
FIG. 8 is a cross-sectional view of a ground pinhole constructed as a third embodiment of the present invention.
Figure 9:
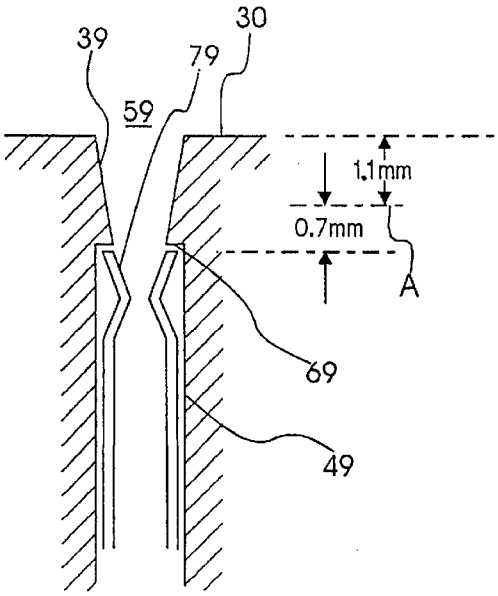
FIG. 9 is a cross-sectional view a signal pinhole constructed as a third embodiment of the present invention.

A D-sub electrical connector constructed as a third embodiment is illustrated in FIGS. 8 and 9. FIG. 8 shows a ground pinhole 58 while FIG. 9 shows a signal pinhole 59. This embodiment contains a first portion formed by a bevelled circular internal sidewall 38, 39 where the diameter in the first portion of the pinhole is greatest at the exterior mating surface 30. The pinholes of the third embodiment contain a second portion 48, 49 that is cylindrical, with a substantially uniform diameter measured perpendicularly to the longitudinal dimention of the pinhole, coaxially concentric to the first portion, and extending inwardly away from the first portion 38, 39 and away from the external border 30. In the third embodiment, the diameter of the first portion shrinks to less than the diameter of the second portion. As a result, a lip 68, 69 is formed at a junction where first portion 38, 39 joins second portion 48, 49, respectively. Electrically conducting ground potential fingers 78 in FIG. 8, and electrically conducting data signal fingers 79 in FIG. 9, never extend to exterior mating surface 30. Instead, the electrically conducting fingers 78, 79 in the third embodiment are situated entirely within the second portion and reach only up to lip 68, 69, respectively.

Like the second embodiment, the third embodiment has different internal sidewall profiles for ground pinhole 58 than for signal pinhole 59. Also like the second embodiment, signal pinholes 59 of the third embodiment have a first portion 39 that extends farther into the device than the first portion 38 for the ground pinholes 58. Like the second embodiment, this results in the creation of a distance between the exterior mating surface 30 and the electrically conducting fingers that is smaller in ground pinholes 58 than in signal pinholes 59. In the third embodiment, as in the second embodiment, if a male connector (not shown) having male electrically conducting pins protruding by equal lengths is connected to a female D-sub connector, electrically conducting fingers 78 within their corresponding ground pinholes will establish electrical contact before electrically conducting fingers 79 in their corresponding signal pinholes do. If any static electricity has built up in the circuits, it would be discharged to ground via the electrically conducting ground fingers prior to mating of the male data signal pins with the corresponding female data signal fingers 79, and not to the electrical components of the input and output circuit stages connected to the data signal pins. Accordingly, this embodiment protects the electronic circuits from harmful static electric discharge.

In the embodiment represented by FIGS. 8 and 9, a reference basis A is illustrated to show where the electrically conducting finger would extend to in a conventional pinhole. FIGS. 8 and 9 show the third embodiment where the distance between the electrically conducting fingers and exterior mating surface 30 for the ground and signal pinholes depart from the basis by the same constant value. In FIGS. 8 and 9, this constant value is also set at approximately 0.7 mm. Thus, in data signal pinhole 59, the distance between exterior mating surface 30 and electrically conducting finger 79 is established as 1.1 mm+0.7 mm=1.8 mm. For the ground pinhole 58, 1.1 mm–0.7 mm=0.4 mm is the distance between the exterior mating surface 30 and the electrically conducting finger 78.

Consequently, a female-type D-sub connector is provided according to the preferred embodiments of the invention which prevents the input-output controlling chips from being damaged due to a power noise or a momentary surge voltage generated by ungrounded signals by constructing the connector in such way that the ground pins are to be grounded earlier than the signals pins when a printer, repeater or any device connector cable is connector. Conversely, during uncoupling of a cable from a connector constructed according to the foregoing principles, the pins at the ground potential break their electrical connections after the pins carrying the data signals.

In the foregoing discussion of details, differences between the conventional D-sub connector and the D-sub connector of the present invention are generally too small and too secluded to be seen by someone with only an exterior view. It should be understood however, that the configurations of the embodiments described serve to provide compatibility in the practice of the present invention with existing cables, such as the cable for a printer, a repeater or other multi-lead device, while enhancing the electrical security of the input and output circuit stages of the device coupled to the cable during coupling and uncoupling.

While there have been illustrated and described what are considered to be preferred embodiments of the present invention, it will be understood by those skilled in the art that various changes and modifications may be made, and equivalents may be substituted for elements thereof with out departing from the true scope of the present invention. In addition, many modifications may be made to adapt a particular situation to the teaching of the present invention without departing from the central scope thereof. Therefore, it is intended that the present invention not be limited to the particular embodiment disclosed as the best mode contemplated for carrying out the present invention, but that the present invention includes all embodiments falling within the scope of the appended claims.

What is claimed is:

1. A surge voltage preventing D-sub connector, comprising:

a plurality of female signal terminals disposed within corresponding different ones of a first plurality of pinholes opening onto an exterior mating surface;

a plurality of female ground terminals disposed within corresponding different ones of a second plurality of pinholes opening onto said exterior mating surface, with a certain point internal to said first plurality and said second plurality of pinholes and spaced apart from said exterior mating surface is set as a basis-point and distal terminal ends of said plurality of female ground terminals are positioned nearer than said basis-point by a substantially constant distance to the exterior mating surface and distal terminal ends of said plurality of female signal terminals are positioned farther than said basis-point by a substantially constant distance from the exterior mating surface, with said distal terminal ends of said plurality of female ground terminals being positioned nearer than said distal terminal ends of said plurality of female signal terminals to the exterior mating surface of the connector:

an annular protrusion formed in each of said first plurality of pinholes and said second plurality of pinholes;

said distal terminal ends of said plurality of female ground terminals being hung on and extending partially coextensively with said protrusion within said second plurality of pinholes; and said distal terminal ends of said .plurality of female signal terminals being hung on and extending partially coextensively with said protrusions of said first plurality of pinholes.

2. A surge voltage preventing D-sub connector comprising:

a plurality of female signal terminals disposed within corresponding different ones of a first plurality of pinholes opening onto a mating surface;

a plurality of female ground terminals disposed within corresponding different ones of a second plurality of pinholes opening onto said mating surface, with a certain point internal to said first plurality and said second plurality of pinholes and spaced apart from said exterior mating surface is set as a basis-point and distal terminal ends of said plurality of female ground terminals are positioned nearer than said basis-point by a substantially constant distance to the exterior mating surface and distal terminal ends of said plurality of female signal terminals are positioned farther than said basis-point by a substantially constant distance from the exterior mating surface, with said distal terminal ends of said plurality of female ground terminals being positioned nearer than said distal terminal ends of said plurality of female signal terminals to the exterior mating surface of the connector, said plurality of female ground terminals being the same shape as said plurality of female signal terminals;

an annular protrusion spaced apart from said mating surface, formed within each of said first plurality of pinholes and said second plurality of pinholes; and said distal terminal ends of said plurality of female ground terminals and said distal terminal ends of said plurality of female signal terminals being held within different corresponding ones of said first and said second pluralities of said pinholes with said distal terminal ends of said plurality of female ground terminals not protruded upward and beyond said protrusion within corresponding ones of said second plurality of pinholes and with said distal terminal ends of said plurality of female signal terminals not protruded upward and beyond said protrusion within corresponding ones of said first plurality of pinholes.

3. A connector, comprising:

a body of an electrically insulating material having a planar face defining an external border perforated by a plurality of ground pinholes and a plurality of signal pinholes extending into said electrically insulative material through said planar face, each of said plurality of ground pinholes and each of said plurality of signal pinholes having internal sidewalls;

a plurality of first electrically conducting fingers, each extending along different corresponding internal sidewalls of each of said plurality of ground pinholes; and a plurality of second electrically conducting fingers, each extending along different corresponding internal sidewalls of each of said plurality of signal pinholes, said first conducting fingers extending nearer than said second conducting fingers to said external border, wherein said internal sidewalls of each of said plurality of ground pinholes and each of said plurality of signal pinholes comprises:

a beveled portion adjacent to said external border, a concentric cylindrical portion extending inwardly from said beveled portion an away from said external border, each one of said plurality of first electrically conducting fingers extending from said cylindrical portion of a corresponding one of said ground pinholes, across said beveled portion of said corresponding one of said plurality of ground pinholes and onto said external border adjacent to said corresponding one of said plurality of ground pinholes, and each one of said plurality of second electrically conducting fingers lying entirely within said cylindrical portion of each corresponding one of said plurality of signal pinholes, wherein each one of said plurality of ground pinholes has the same shape as each one of said plurality of signal pinholes.

4. The connector of claim 3, wherein said connector is a D-sub connector.

5. A connector, comprising:

a body of an electrically insulating material having a planar face defining an external border perforated by a plurality of ground pinholes and a plurality of signal pinholes extending into said electrically insulative material through said planar face, each of said plurality of ground pinholes and each of said plurality of signal pinholes having internal sidewalls;

a plurality of first electrically conducting fingers, each extending along different corresponding internal sidewalls of each of said plurality of ground pinholes; and a plurality of second electrically conducting fingers, each extending along different corresponding internal sidewalls of each of said plurality of signal pinholes, said first conducting fingers extending nearer than said second conducting fingers to said external border, wherein said internal sidewalls of each of said plurality of ground pinholes and each of said plurality of signal pinholes comprises:

a fast cylindrical portion having a first diameter, said first cylindrical portion adjacent to said external border, a second concentric cylindrical portion having a second and smaller diameter extending inwardly from said first cylindrical portion and away from said external border, and an annular surface being formed where said first cylindrical portion joins said second cylindrical portion, wherein each one of said plurality of ground pinholes having the same shape as each one of said plurality of signal pinholes, with the exception that said first cylindrical portion of each of said plurality of ground pinholes being shorter than said first cylindrical portion of each of said plurality of signal pinholes, wherein each one of said plurality of first electrically conducting fingers and each one of said plurality of second electrically conducting fingers extend from said second cylindrical portion and across said annular surface formed between said first cylindrical portion and said second cylindrical portion allowing said plurality of first electrically conducting fingers and said plurality of second electrically conducting fingers to hang on said annular surface.

6. A connector, comprising:

a body of an electrically insulating material having a planar face defining an external border perforated by a plurality of ground pinholes and a plurality of signal pinholes extending into said electrically insulative material through said planar face, each of said plurality of ground pinholes and each of said plurality of signal pinholes having internal sidewalls;

a plurality of first electrically conducting fingers, each extending along different corresponding internal sidewalls of each of said plurality of ground pinholes; and a plurality of second electrically conducting fingers, each extending along different corresponding internal sidewalls of each of said plurality of signal pinholes, said first conducting fingers extending nearer than said second conducting fingers to said external border, wherein said internal sidewalls of each of said plurality of ground pinholes and each of said plurality of signal pinholes comprises:

a beveled portion adjacent to said external border, said beveled portion having a first diameter where said beveled portion joins said external border, and a cylindrical portion having a third diameter, said cylindrical portion concentric to and extending inwardly from said beveled portion away from said external border, said beveled portion having a second diameter where said beveled portion joins said cylindrical portion, said second diameter being smaller than said third diameter, an annular surface being formed where said beveled portion joins said cylindrical portion, said annular surface being parallel to and facing away from said external border, wherein each one of said plurality of ground pinholes has the same shape as each one of said plurality of signal pinholes with the exception that said beveled portion for said plurality of ground pinholes is shorter than said beveled portion of said plurality of signal pinholes, each one of said plurality of first electrically conducting fingers and each one of said plurality of second electrically conducting fingers extends from said cylindrical portion to said annular surface facing away from said external border in each one of said plurality of ground pinholes and in each one of said plurality of signal pinholes respectively.

7. An electrical connector system, comprising:

a plurality of pins extending from a first connector of electrically insulating material, each one of said plurality of pins having a distal end, said plurality of pins being parallel to each other and of equal length said distal ends of said pins define a planar surface perpendicular to said plurality of pins; and a second connector of electrically insulating material having a planar face defining an exterior mating surface, said exterior mating surface perpendicularly perforated by:

a plurality of signal pinholes, each one of said plurality of signal pinholes having a female signal terminal located therein, each said female signal terminal having a distal end, and a plurality of ground pinholes, each one of said plurality of ground pinholes having a female ground terminal located therein, each said female ground terminal having a distal end, said distal end of each said female ground terminal extending closer to said exterior mating surface of said second connector than said distal end of each said female signal terminal with the size and shape of each one of said plurality of ground pinholes and each one of said plurality of signal pinholes comprising:

a cylindrical portion having a first diameter, and a beveled portion extending inward from said exterior mating surface to said cylindrical portion, said beveled portion concentric to said cylindrical portion, said beveled portion having a first diameter at said cylindrical portion, said beveled portion having a second diameter at said exterior mating surface, the diameter of said beveled portion varying linearly between said cylindrical portion and said exterior mating surface, said second diameter larger than said first diameter.

8. The electrical connector system of claim 7, with said distal end of each said female signal terminal located within said cylindrical portion of each one of said plurality of signal pinholes near said beveled portion, said distal end of each said female ground terminal located on said exterior mating surface near said beveled portion of each corresponding ones of said plurality of ground pinholes, wherein each said female ground terminal extends across said beveled portion of each corresponding ones of said plurality of ground pinholes.

9. The electrical connector system of claim 8, with said electrical connector system being comprised of D-sub connectors.

10. An electrical connector system, comprising:

a plurality of pins extending from a first connector of electrically insulating material, each of said plurality of pins having a distal end, said plurality of pins being parallel to each other and of equal length, said distal ends of said pins define a planar surface perpendicular to said plurality of pins;

a second connector of electrically insulating material having a planar face defining an exterior mating surface, said exterior mating surface perforated perpendicularly by a plurality of signal pinholes, each of said plurality of signal pinholes containing a female signal terminal, each of said female signal terminal having a distal end;

said exterior mating surface of said second conductor perforated perpendicularly by a plurality of ground pinholes, each of said plurality of ground pinholes having a female ground terminal within, each of said female ground terminals having a distal end;

each of said plurality of ground pinholes and each of said plurality of signal pinholes having a first cylindrical portion and a second cylindrical portion, both said first cylindrical portion and second cylindrical portion orthogonal to said exterior mating surface, said first cylindrical portion having a first diameter, said a second cylindrical portion concentric to said first cylindrical portion, said second cylindrical portion having a second diameter, said second cylindrical portion extending between said first cylindrical portion and said exterior mating surface of said second connector, said second diameter being larger than said first diameter, said first cylindrical portion and said second cylindrical portion forming an annular surface therebetween, said annular surface being parallel to said exterior mating surface, each one of said plurality of signal pinholes having the same shape as each one of said plurality of said ground pinholes except that said second cylindrical portion of each one of said plurality of signal pinholes extends deeper into said second connector and further away from said exterior mating surface than said second cylindrical portion of each one of said plurality of ground pinholes;

said distal ends of each of said female signal terminals located at said annular surface found within each respective ones of said plurality of signal pinholes; and said distal ends of each of said female ground terminals located at said annular surface found within each respective ones of said plurality of ground pinholes, whereby said distal ends of said female ground terminals are located closer to said exterior mating surface than said distal ends of said female signal terminals.

11. The electrical connector system of claim 10, with said electrical connector system being comprised of D-sub connectors.

12. An electrical connector system, comprising:

a plurality of pins extending from a first connector of electrically insulating material, each of said plurality of pins having a distal end, said plurality of pins being parallel to each other and of equal length, said distal ends of said pins define a planar surface perpendicular to said plurality of pins;

a second connector of electrically insulating material having a planar face defining an exterior mating surface, said exterior mating surface perforated perpendicularly by a plurality of signal pinholes, each of said plurality of signal pinholes containing a female signal terminal, each of said female signal terminal having a distal end;

said exterior mating surface of said second conductor perforated perpendicularly by a plurality of ground pinholes, each of said plurality of ground pinholes having a female ground terminal within, each of said female ground terminals having a distal end; and each of said plurality of ground pinholes and each of said plurality of signal pinholes having:

a beveled portion adjacent to said external mating surface, said beveled portion having a first diameter where said beveled portion joins said external mating surface, and a cylindrical portion having a third diameter, said cylindrical portion concentric to and extending inwardly from said beveled portion and away from said external mating surface, said cylindrical portion perpendicular to said external mating surface, said beveled portion having a second diameter where said beveled portion joins said cylindrical portion, said second diameter being smaller than said third diameter, an annular surface being formed where said beveled portion joins said cylindrical portion, said annular surface being parallel to and facing away from said external mating surface, wherein each of said plurality of ground pinholes has the same shape as each one of said plurality of said signal pinholes with the exception that said beveled portion for each one of said plurality of ground pinholes is shorter than said beveled portion for each one of said plurality of signal pinholes, said distal ends of each said female ground terminal and said distal ends of each said female signal terminal being located in said cylindrical portion near said annular surface of each corresponding one of said plurality of ground pinholes and each corresponding one of said plurality of signal pinholes respectively.

13. The electrical connector system of claim 12, with said electrical connector system being comprised of D-sub connectors.

* * * * *